US008993087B2

(12) United States Patent
Bovenschen et al.

(10) Patent No.: US 8,993,087 B2
(45) Date of Patent: Mar. 31, 2015

(54) BALLISTIC-RESISTANT ARTICLES

(75) Inventors: Soon Joo Bovenschen, Arnhem (NL); Joris Van Der Eem, Arnhem (NL); Sanjay Rastogi, Eindhoven (NL); Jules Armand Wilhelmina Harings, Nijmegen (NL); Adriaan Anton Schaap, Oosterbeek (NL)

(73) Assignee: Teijin Aramid B.V., Arnheim (NL)

( * ) Notice: Subject to any disclaimer, the term of this patent is extended or adjusted under 35 U.S.C. 154(b) by 343 days.

(21) Appl. No.: 13/518,562

(22) PCT Filed: Dec. 23, 2010

(86) PCT No.: PCT/EP2010/070633

§ 371 (c)(1),
(2), (4) Date: Jun. 22, 2012

(87) PCT Pub. No.: WO2011/076914

PCT Pub. Date: Jun. 30, 2011

(65) Prior Publication Data

US 2012/0255430 A1 Oct. 11, 2012

(30) Foreign Application Priority Data

Dec. 23, 2009 (EP) ..... 09180611

(51) Int. Cl.
*F41H 5/04* (2006.01)
*B32B 37/10* (2006.01)

(52) U.S. Cl.
CPC ..... *F41H 5/0485* (2013.01)
USPC ..... 428/105; 428/107; 428/156; 428/213; 428/364

(58) Field of Classification Search
CPC ..... F41H 5/0485
USPC ..... 428/105, 107, 156, 213, 364
See application file for complete search history.

(56) References Cited

U.S. PATENT DOCUMENTS

| | | | |
|---|---|---|---|
| 2004/0081815 | A1 | 4/2004 | Baudonnel |
| 2008/0241494 | A1 | 10/2008 | Ardiff et al. |

FOREIGN PATENT DOCUMENTS

| | | | | |
|---|---|---|---|---|
| EP | 0 193 478 | A1 | 9/1986 | |
| EP | 1 354 991 | A1 | 10/2003 | |
| WO | WO 91/12136 | A1 | 8/1991 | |
| WO | WO 97/00766 | A1 | 1/1997 | |
| WO | WO 2005/098343 | A1 | 10/2005 | |
| WO | WO 2008/048301 | A2 | 4/2008 | |
| WO | WO 2008048301 | A2 * | 4/2008 | ..... F41H 1/02 |

(Continued)

OTHER PUBLICATIONS

International Search Report issued in International Patent Application No. PCT/EP2010/070633 dated Apr. 29, 2011.

(Continued)

*Primary Examiner* — Brent O'Hern
(74) *Attorney, Agent, or Firm* — Oliff PLC

(57) ABSTRACT

A ballistic-resistant article includes a stack of sheets containing reinforcing linear tension members, the direction of the linear tension members within the stack being no unidirectionally, wherein some of the linear tension members are linear tension members comprising high molecular weight polyethylene and some of the linear tension members comprise aramid. A sheet and a consolidated sheet package contain the ballistic-resistant article, and a method of manufacturing produces the ballistic-resistant article.

11 Claims, 3 Drawing Sheets

Front and back of Example 1 panel after 5 shots

(56) References Cited

FOREIGN PATENT DOCUMENTS

| | | | |
|---|---|---|---|
| WO | WO 2009/068541 | A2 | 6/2009 |
| WO | WO 2009/109632 | A1 | 9/2009 |

OTHER PUBLICATIONS

Written Opinion issued in International Patent Application No. PCT/EP2010/070633 dated Apr. 29, 2011.

* cited by examiner

Figure 1: Front and back of Comparative Example 1 panel after 5 shots
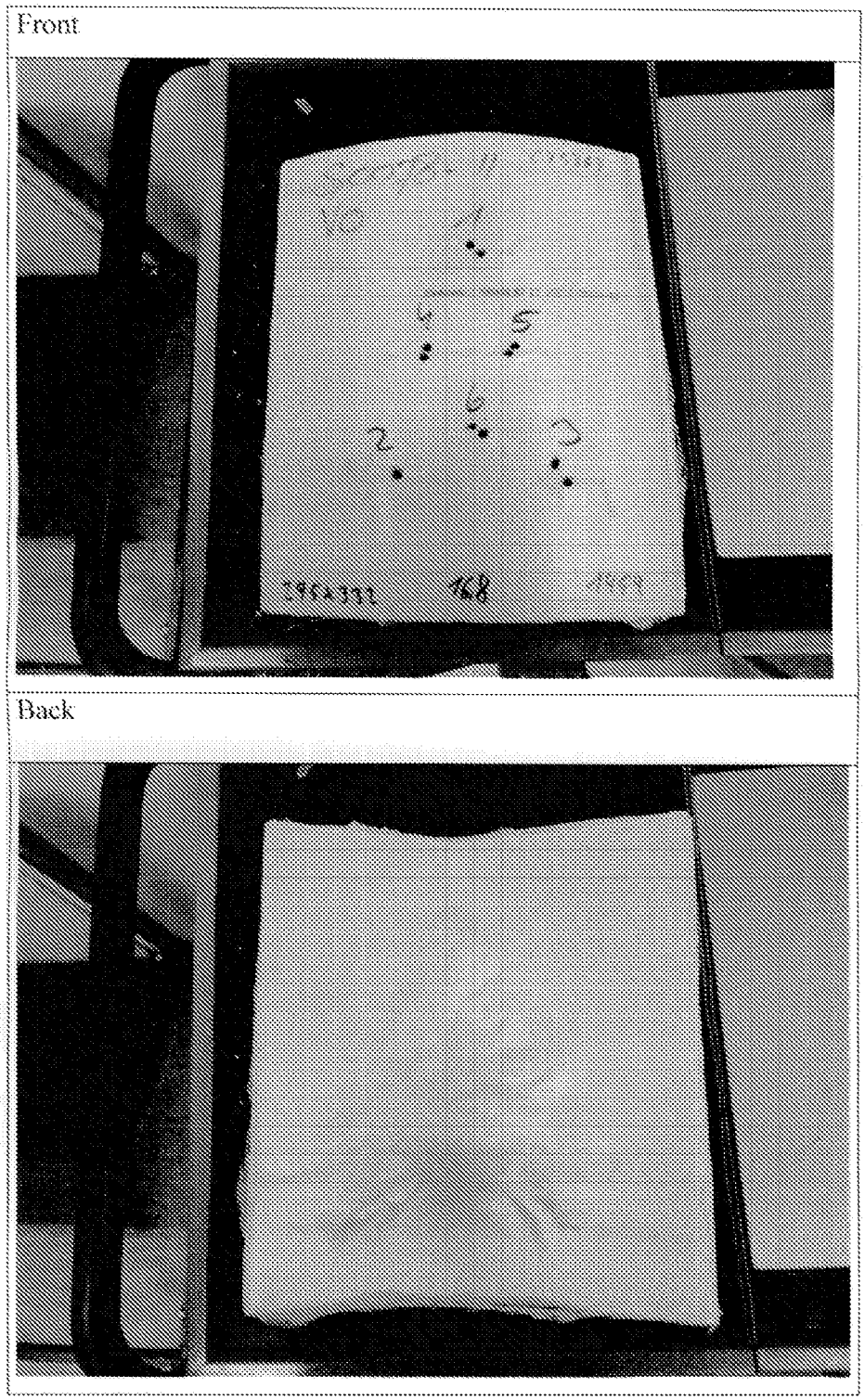

Figure 2: Front and back of Example 1 panel after 5 shots
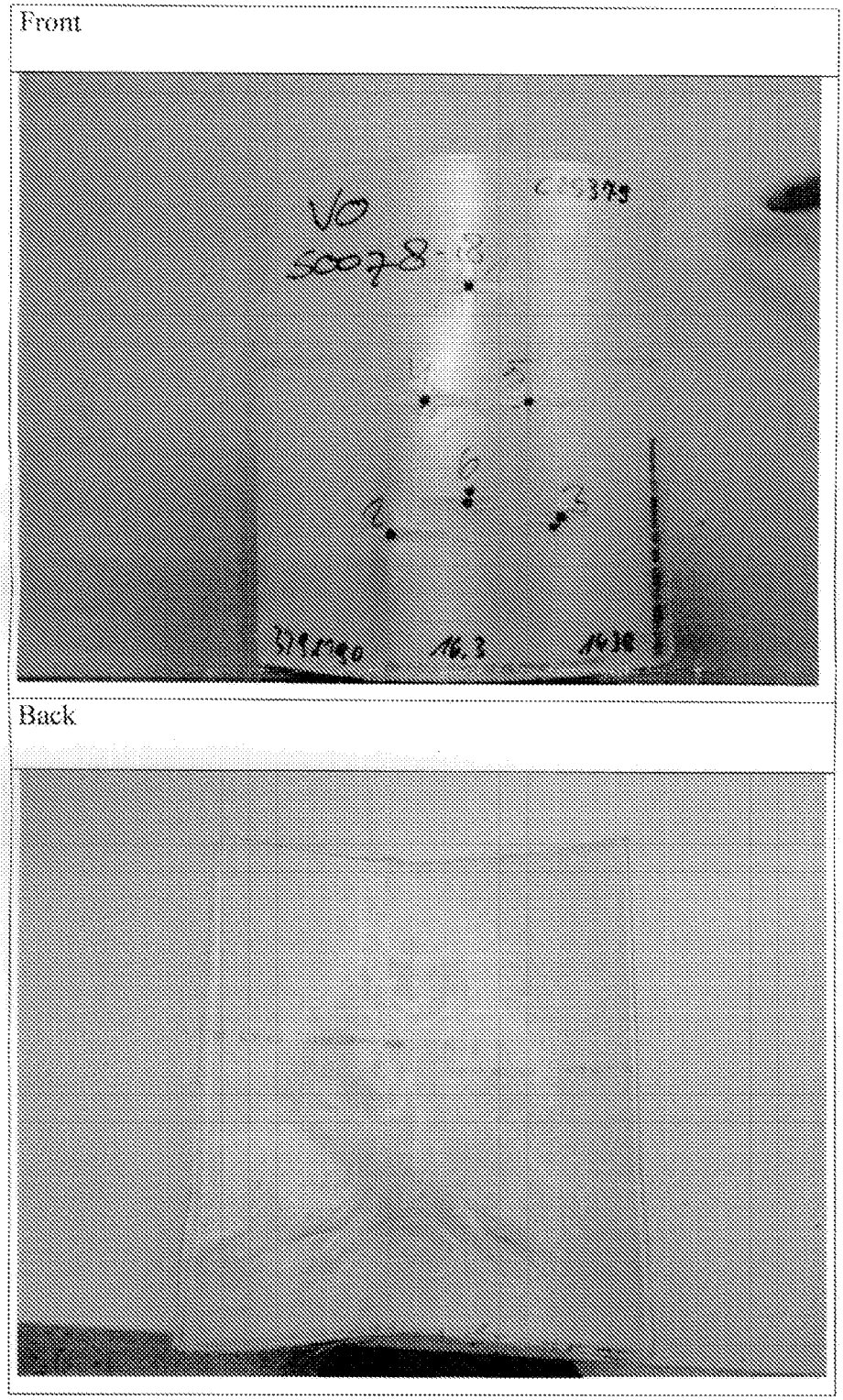

Figure 3: Front and back of Example 3 panel after 5 shots
Front
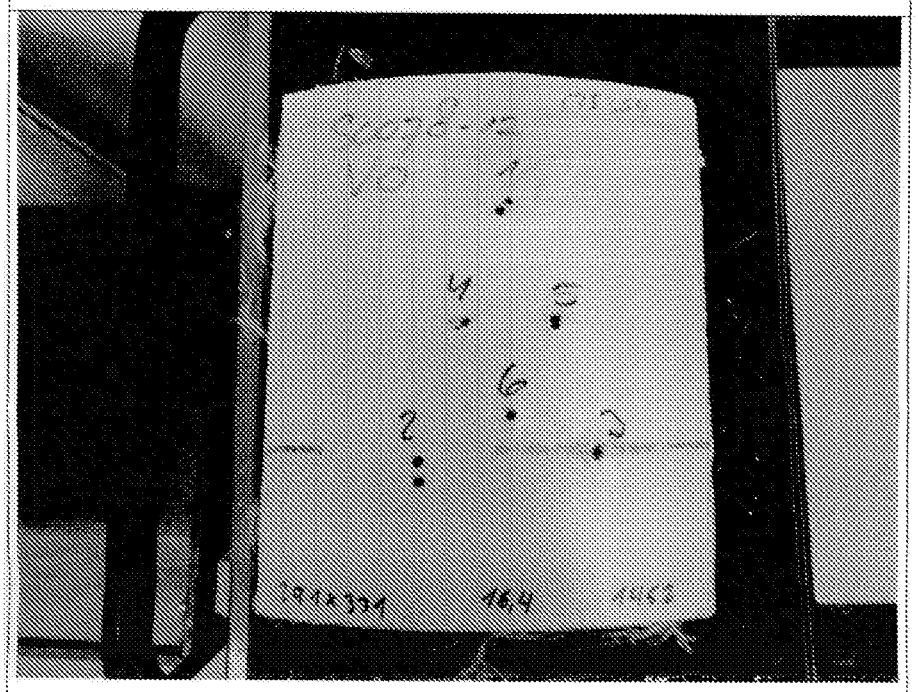
Back
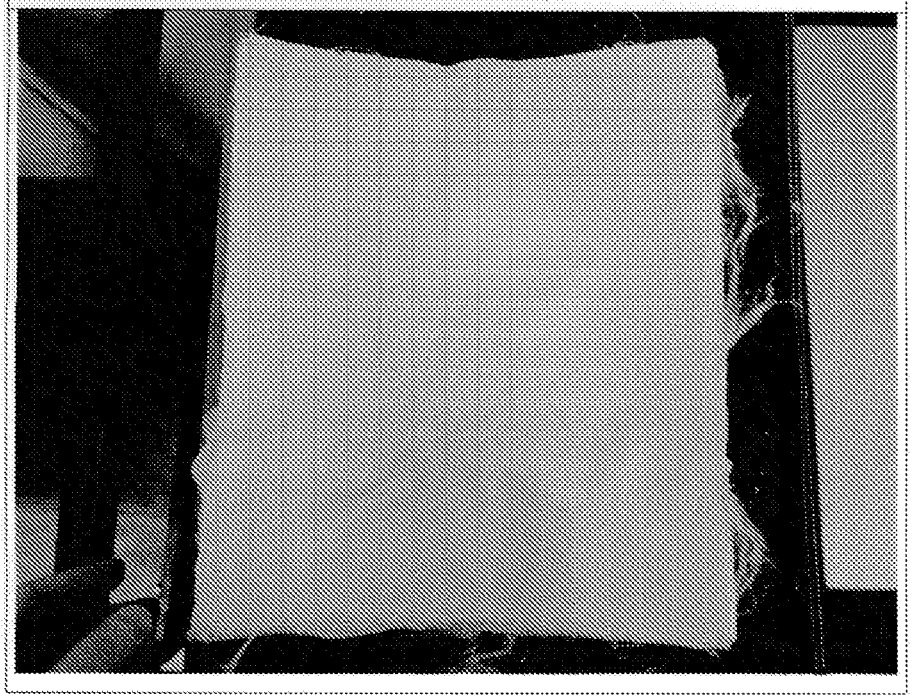

BALLISTIC-RESISTANT ARTICLES

TECHNICAL FIELD

The present disclosure pertains to ballistic-resistant articles, sheets suitable for use in the manufacture of ballistic-resistant articles, a consolidated sheet package, and a method for manufacturing a ballistic-resistant article.

Ballistic-resistant articles are known in the art. They are available in numerous different kinds. On the one hand, there are soft-ballistic articles, for example for use in bulletproof vests. On the other, there are molded bodies, serving, for example, as shields in another type of bulletproof vests, or as helmets. Further, ballistic-resistant articles are used in cars, buildings, and other objects intended to help protect people, animals, or goods from ballistic impact.

In the art, ballistic-resistant articles often comprise a stack of sheets containing high-strength fibers, such as aramid, or polyethylene. Depending on the application, the sheets may be pressed together to form a molded article, or bonded together at the edges to form a soft-ballistic article. However, there is need for a ballistic-resistant article with improved properties.

The use of different materials in antiballistic panels has been suggested.

WO2005098343 describes an armour system with a hardened strike panel and a backing panel. Materials mentioned as being suitable for the strike panel include granite, ceramic tile, brick, glass, and hardened concrete. Materials mentioned as being suitable for the packing panel include glass, aramid, polyethylene, carbon, and metallic materials.

WO2008048301 is directed to a composite material for forming a flexible bullet-resistant body armor comprising at least one fibrous layer having a network of high tenacity fibers. The high tenacity fibers may be polyethylene ("PE") fibers, aramid fibers, or at least 8 other type of fibers. WO2008048301 generally mentions that the yarns and fabrics may be comprised of one or more different fibers, although it is preferred that they are the same.

SUMMARY

Improvement in the performance of ballistic materials may be obtained if a combination of two types of high-performance material is used, for example, aramid material and high molecular weight polyethylene. Accordingly, the present disclosure pertains to a ballistic-resistant article comprising a stack of sheets containing reinforcing linear tension members, the direction of the linear tension members within the stack being not unidirectionally, wherein some of the linear tension members are linear tension members comprising high molecular weight polyethylene and some of the linear tension members comprise aramid.

BRIEF DESCRIPTION OF THE DRAWINGS

FIG. 1 is a front and back view of the panel of Comparative Example 1 after 5 shots.

FIG. 2 is a front and back view of Example 1 after 5 shots.

FIG. 3 is a front and back view of Example 3 after 5 shots.

DETAILED DESCRIPTION

The Linear Tension Members

As used herein, "linear tension member" refers to an object the largest dimension of which, the length, is larger than the second smallest dimension, the width, and the smallest dimension, the thickness. The ratio between the length and the width may be at least 10. The maximum ratio is not critical and may depend on processing parameters. As a general value, a maximum length to width ratio of 1,000,000 may be mentioned.

Accordingly, the linear tension members may encompass monofilaments, multifilament yarns, threads, tapes, strips, staple fiber yarns, and other elongate objects having a regular or irregular cross-section.

In one embodiment, the linear tension member is a fiber, that is, an object of which the length is larger than the width and the thickness, while the width and the thickness are within the same size range. The ratio between the width and the thickness may be in the range of 10:1 to 1:1, for example between 5:1 and 1:1, or between 3:1 and 1:1. The fibers may have a more or less circular cross-section. In this case, the width may be the largest dimension of the cross-section, while the thickness may be the shortest dimension of the cross section.

For fibers, the width and the thickness may be at least 1 micron, for example at least 7 micron. In the case of multifilament yarns, the width and the thickness may be quite large, e.g., up to 2 mm. For monofilament yarns, a width and thickness of up to 150 micron may be more conventional. As an example, fibers with a width and thickness in the range of 7-50 microns may be mentioned.

As used herein, a "tape" is defined as an object of which the length, i.e., the largest dimension of the object, is larger than the width, the second smallest dimension of the object, and the thickness, i.e., the smallest dimension of the object, while the width is in turn larger than the thickness. The ratio between the length and the width may be at least 2, for example at least 4, or at least 6. The maximum ratio is not critical and may depend on processing parameters. As a general value, a maximum length to width ratio of 200,00 may be mentioned. The ratio between the width and the thickness may be more than 10:1, for example more than 50:1, or more than 100:1. The maximum ratio between the width and the thickness is not critical and may be, for example, at most 2000:1.

The width of the tape may be at least 1 mm, for example at least 2 mm, at least 5 mm, at least 10 mm, at least 20 mm, or at least 40 mm. The width of the tape may be, for example, at most 200 mm. The thickness of the tape may be at least 8 microns, for example at least 10 microns. The thickness of the tape may be, for example, at most 150 microns, such as at most 100 microns. In one embodiment, tapes are used with a high linear density. As used herein, the linear density is expressed in dtex, which is the weight in grams of 10,000 meters of film. In one embodiment, tapes are used with a linear density of at least 3000 dtex, for example at least 5000 dtex, at least 10000 dtex, at least 15000 dtex, or at least 20000 dtex.

The use of tapes may be attractive, because it may enable the manufacture of ballistic materials having very good ballistic performance, good peel strength, and low areal weight. This goes in particular for polyethylene.

As used herein, weight percentages of linear tension members refer to the high-strength constituent of such member, viz., the polyethylene, aramid, or other high-strength polymer. Any coatings or finishing present on the linear tension member is calculated to belong to the matrix material.

The Composition of the Stack

The stack comprises sheets containing linear tension members. As used herein, the term "sheet" refers to an individual sheet comprising linear tension members, which sheet can individually be combined with other, corresponding sheets. The sheet may or may not comprise a matrix material, as will be elucidated below.

The sheets comprising the linear tension members used in the stack may have different compositions.

In one embodiment, sheets are prepared by weaving linear tension members. In one embodiment, tapes are used as warp and weft. In another embodiment, tapes are used as warp or weft, and fibers are used as weft or warp. In a further embodiment, fibers are used as both warp and weft.

Weaving may be used to manufacture sheets which contain polyethylene and not aramid, e.g. polyethylene only, and to manufacture sheets which contain aramid and not polyethylene, e.g., aramid only. Weaving may also be used to manufacture sheets which contain both linear tension members comprising aramid and linear tension members comprising polyethylene. In one embodiment, the woven sheet comprises one linear tension member of polyethylene and aramid linear as warp or weft and another linear tension member of polyethylene and aramid linear as weft or warp. It may also be possible to use a combination of aramid linear tension members and polyethylene linear tension members in the warp, or in the weft, or both in the warp and in the weft.

It is also possible to use linear tension members which comprise both aramid and polyethylene in the woven sheet.

Various conventional weaving methods may be applied. The weft member can cross over one, two, or more warp members, and the sequential weft members can be applied alternating or in parallel. One embodiment is the plain weave, wherein the warp and weft are aligned so that they form a simple criss-cross pattern, which is made by passing each weft member over and under each warp member, with each row alternating, producing a high number of intersections. A further embodiment is based on the satin weave, in which two or more weft members float over a warp member, or vice versa, two or more warp members float over a single weft member. A still further embodiment is derived from the twill weave, in which one or more warp members alternately weave over and under two or more weft members in a regular repeated manner. This embodiment produces the visual effect of a straight or broken diagonal 'rib' to the fabric. A still further embodiment is based on the basket weave, which is fundamentally the same as plain weave except that two or more warp fibers alternately interlace with two or more weft fibers. An arrangement of two warps crossing two wefts is designated 2×2 basket, but the arrangement of fiber need not be symmetrical. Therefore it is possible to have 8×2, 5×4, etc. A still further embodiment is based on the mock leno weave, which is a version of plain weave in which occasional warp members, at regular intervals but usually several members apart, deviate from the alternate under-over interlacing and instead interlace every two or more members. This happens with similar frequency in the weft direction, and the overall effect is a fabric with increased thickness, rougher surface, and additional porosity.

Each weave type has associated characteristics. For example, where a system is used in which the weft crosses one, or a small number, of warp members, and the individual weft members are used alternating, or almost alternating, the sheet will contain a relatively large number of intersections. An intersection, as used herein, is a point where a weft member goes from one side of the sheet, the A side, to the other side of the sheet, the B side, and an adjacent weft member goes from the B side of the sheet to the A side of the sheet. Where a system is used in which the weft crosses one, or a limited number of warp members, or vice versa, where the warp crosses one or a limited number of weft members, a large number of deflection lines will exist. Deflection lines occur where one member goes from one side of the sheet to the other side and are formed by the edge of the crossover member. These deflection lines may contribute to the dissipation of impact energy in the X-Y direction of the sheet. The use of plain weaves may be preferred, because they are relatively easy to manufacture, and they are homogeneous in that a rotation of 90° will not change the nature of the material, combined with good ballistic performance.

Suitable tape weaving processes are known in the art, as described in, for example, EP 1354991.

In one embodiment, the linear tension members in a sheet are unidirectionally oriented, and the direction of the linear tension members in a sheet is rotated with respect to the direction of the linear tension members of other sheets in the stack, in particular with respect to the direction of the linear tension members in adjacent sheets. Good results may be achieved when the total rotation within the stack amounts to at least 45 degrees, for example to approximately 90 degrees. In one embodiment, the stack comprises adjacent sheets wherein the direction of the linear tension members in one sheet is perpendicular to the direction of linear tension members in adjacent sheets.

In this embodiment, a sheet may be provided by parallel aligning of linear tension members, and then causing the linear tension members to adhere, for example, by temperature and pressure, or by using a matrix material.

In one embodiment, where the linear tension members are fibers, a sheet may be manufactured by parallel aligning of the fibers, and then providing a matrix material between the fibers in an amount sufficient to cause the fibers to adhere.

When the linear tension members are tapes, there may be a number of possibilities to prepare suitable sheets by parallel alignment of tapes. In one embodiment, a single layer of parallel tapes is provided which are then adhered to each other using a matrix material, analogous to what has been described above for fibers.

In another embodiment, a sheet is provided by provision of parallel tapes in an overlapping fashion, and then causing the tapes to adhere to each other. In one embodiment, tapes are aligned in such a manner that a first longitudinal edge of the tape is below the tape adjacent on one side and the second longitudinal edge of the tape is above the adjacent tape on the other side (roof-tiling construction). In another embodiment, tapes are aligned in a brick-layering fashion, wherein, in a first step, a first layer of parallel tapes is provided, and, in a second step, a second layer of tapes is provided, parallel to the tapes in the first layer, wherein the tapes in the second layer are off-set as compared to the tapes in the first layer. If so desired, third and further layers of tapes may be provided. The tapes are then integrated to form a sheet by using temperature and pressure, by using a matrix material, or by a combination thereof.

It may also be possible to manufacture a sheet by first providing a layer of tapes or fibers aligned in a first direction, then providing a layer of tapes or fibers aligned in a second direction at an angle to the first direction, and then adhering the layers together to form a sheet.

If so desired, fibers and tapes may be used in combination in a single sheet. In one embodiment, the sheet contains polyethylene linear tension members and not aramid linear tension members. In another embodiment, the sheet contains aramid linear tension members and not polyethylene linear tension members. In a further embodiment, the sheet comprises both aramid linear tension members and polyethylene linear tension members. It is again also possible to use linear tension members which contain both aramid and polyethylene.

Some of the linear tension members may be linear tension members comprising molecular weight polyethylene and some of the linear tension members comprise aramid. In addition to linear tension members of polyethylene alone, or aramid alone, linear tension members containing both aramid and polyethylene may be used. The use of hydrid fibers may be mentioned as an example.

The ballistic-resistant article of the present invention may comprise additional types of high-performance linear tension members, e.g., linear tension members of liquid crystalline polymer and linear tension members of highly oriented polymers, such as polyesters, polyvinylalcoholes, polyolefineketone (POK), polybenzobisoxazoles, polybenz (obis) imidazoles, poly{2,6-diimidazo[4,5-b:4,5-e]-pyridinylene-1,4(2,5-dihydroxy)phenylene} (PIPD or M5), and polyacrylonitrile.

The linear tension members in the ballistic-resistant article may be, for example, at least 80 wt. % aramid and polyethylene, in particular at least 90 wt. %, and more in particular at least 95 wt. %. In one embodiment, the linear tension members in the ballistic-resistant article are essentially aramid material and polyethylene.

Of the total weight of linear tension members used, the weight percentage of aramid may be at least 1%, for example, at least 5%, at least 10%, at least 15%, or at least 20%. The weight percentage of aramid linear tension members may be at most 60%, for example at most 50%, or at most 40%. In one embodiment, the weight percentage of aramid is between 1 and 20 wt. % of the total weight of linear tension members used in the stack, more specifically between 1 and 10 wt. %, the balance preferably being UHMWPE. In another embodiment, the weight percentage of aramid is between 15 and 40 wt. %, in particular between 15 and 30 wt. %, the balance preferably being UHMWPE. Generally, of the total weight of linear tension members used, the weight percentage of UHMWPE may be at least 10%, for example at least 15%, or at least 20%. In one embodiment, the weight percentage of UHMWPE members may be at least 40%, at least 50%, or even at least 60%, in particular at least 80%, more in particular at least 90%, even more in particular at least 95%. Generally, the weight percentage of polyethylene may be at most 99%.

The distribution of the aramid and polyethylene linear tension members through the stack may be performed in different manners. In one embodiment, the stack comprises sheets, which contain both polyethylene linear tension members and aramid linear tension members. In another embodiment, the stack comprises sheets, which contain polyethylene linear tension members and are free of aramid linear tension members and/or sheets which contain aramid linear tension members and are free of polyethylene linear tension members.

In one embodiment, the polyethylene linear tension members and aramid linear tension members are distributed homogeneously over the thickness of the stack. That is, when the stack is split along a plane parallel to the plane of the stack, the composition of the two or more parts thus obtained is the same.

In another embodiment, the polyethylene linear tension members and aramid linear tension members are distributed inhomogeneously over the thickness of the stack. That is, when the stack is split along a plane parallel to the plane of the stack, the composition of the two or more parts thus obtained is different.

In one embodiment, the stack, or the molded panel derived from the stack by compressing the sheets together, comprises layers with different compositions, wherein each layer can contain one or more sheets. For example, the stack can comprise two layers, three layers, or more layers, wherein the layers have different compositions from the layers adjacent thereto. Each layer may comprise a combination of polyethylene-based sheets and aramid-based sheets, but may also be a polyethylene-only layer or an aramid-only layer.

In one embodiment, the article comprises a layer which contains more than 50 wt. % polyethylene linear tension members and a layer which contains more than 50 wt. % aramid linear tension members. For example, the polyethylene-rich layer may comprise more than 50 wt. % polyethylene-based sheets and less than 50 wt. % aramid-based sheets.

In one embodiment, the layer which comprises more than 50 wt. % polyethylene linear tension members, which also may be indicated as the polyethylene-rich layer, comprises more than 60% said members, or more than 70% said members, or more than 80%, or more than 90%, or more than 95%. In one embodiment, said layer consists essentially of polyethylene linear tension members.

The polyethylene-rich layer is preferably present at or near the strike face of the article, for examples, at the strike face of a molded panel, where it may serve to fragment the bullet. In one embodiment, the layer which comprises more than 50 wt. % aramid linear tension members, which may also be indicated as aramid-rich layer, comprises more than 60% said members, or more than 70% said members, or more than 80%, or more than 90%. In one embodiment, said layer consists essentially of aramid linear tension members. In one embodiment, this layer is present below (from the strike side) the polyethylene-rich layer. In this embodiment, the aramid-rich layer may serve to catch the bullet fragments, and/or to reduce trauma. The aramid layer may further contribute to preserving the integrity of the panel upon bullet impact.

Unless indicated otherwise, weight percentages of one type of linear tension member are weight percentages calculated on the total of linear tension members in the layer, excluding matrix material. Thus, layers consisting essentially of polyethylene linear tension members or aramid linear tension members may comprise matrix material.

In one embodiment, an aramid-rich layer, as specified above, is present at the top of the article, for example, in the case of molded articles, such as shields or helmets. This layer may serve to provide increased hardness to the article and to improve its fire resistance. In this embodiment a stack of at least three layers may be preferred, wherein the top layer is an aramid-rich layer, the second layer is a polyethylene-rich layer, and the third layer is again an aramid-rich layer.

In a further embodiment, a stack comprises, from the strike face down, a polyethylene-rich layer, and a layer comprising equal amounts of polyethylene and aramid. This may optionally be combined with one or more aramid-rich layers, which may contain different amounts or aramid.

In a further embodiment, a stack comprises at least two polyethylene-rich layers, wherein the first polyethylene-rich layer has a higher polyethylene content than the second layer. The first polyethylene-rich layer may be closer to the strike face of the stack than the second layer. Alternatively, the second layer (i.e. the layer with a lower polyethylene content) may be closer to the strike face of the stack. This may optionally be combined with one or more polyethylene-rich layers and/or aramid-rich layers, which may contain different amounts of polyethylene or aramid respectively.

In general, the stack may comprise 10-99 wt. %, in particular 10-90 wt. %, polyethylene rich layers, calculated on the total stack, and 1-90 wt. %, in particular 10-90 wt. %, aramid-rich layers, calculated on the total stack.

In one embodiment, the stack comprises at least 30 wt. % polyethylene-rich layers (which may be in one or more individual layers), preferably at least 40 wt. %, more preferably at least 50 wt. %, even more preferably at least 60 wt. %, even more preferably at least 80 wt. %, even more preferably at least 90 wt. %, even more preferably at least 95 wt. %. In another embodiment, the stack comprises at least 5 wt. % aramid-rich layers, in particular at least 10 wt. %, more in particular at least 15 wt. %, and even more in particular 20 wt. % of aramid-rich layers.

For polyethylene, the linear tension members may be polyethylene tapes. For width and thickness specification of the tapes, reference is made to what is stated above for tapes in general. The tapes should be suitable for use in ballistic applications, which, more specifically, requires that they have a high tensile strength, a high tensile modulus, and a high energy absorption, reflected in a high energy-to-break. The tapes may have a tensile strength of at least 1.0 GPa, a tensile modulus of at least 40 GPa, and a tensile energy-to-break of at least 15 J/g.

In one embodiment, the tensile strength of the tapes is at least 1.2 GPa, more in particular at least 1.5 GPa, still more in particular at least 1.8 GPa, even more in particular at least 2.0 GPa. In a particularly preferred embodiment, the tensile strength is at least 2.5 GPa, more in particular at least 3.0 GPa, still more in particular at least 4 GPa.

In another embodiment, the tapes have a tensile modulus of at least 50 GPa, wherein the modulus may be determined in accordance with ASTM D882-00. More in particular, the tapes may have a tensile modulus of at least 80 GPa, more in particular at least 100 GPa. In a preferred embodiment, the tapes have a tensile modulus of at least 120 GPa, even more in particular at least 140 GPa, or at least 150 GPa. The modulus may be determined in accordance with ASTM D882-00.

In another embodiment, the tapes have a tensile energy to break of at least 20 J/g, in particular at least 25 J/g, at least 30 J/g, at least 35 J/g, at least 40 J/g, or at least 50 J/g. The tensile energy to break is determined in accordance with ASTM D882-00 using a strain rate of 50%/min. It may be calculated by integrating the energy per unit mass under the stress-strain curve.

More details on suitable types of polyethylene tapes and fibers and methods for the manufacture thereof will be provided below.

The aramid linear tension members may be fibers or tapes.

The fibers may be monofilament yarn or multifilament yam. Suitable aramid fibers may consist of aramid filaments having a tenacity of at least 2.6 GPa, for example, at least 3.1 GPa, or at least 3.6 GPa, and a modulus of at least 60 GPa, for example, at least 75 GPa or at least 90 GPa. Dependent on the amount of filaments and the type of twist applied the properties of the thus obtained twisted fibers or yarns may vary. Under normal circumstances the twisted yams may have a tenacity of at least 2.1 GPa, for example, at least 2.6 GPa, at least 3.1, or at least 3.6 GPa, and a modulus of at least 60 GPa, for example at least 80 GPa, or at least 100 GPa.

In one embodiment, aramid tapes are used. In one embodiment, the aramid tapes are obtained by parallel aligning of aramid fibers and causing them to adhere via a matrix material.

Optionally, the aramid tapes may be adhered by the alternative or additional provision of weft yarns to keep the fibers together. Such tape manufacturing processes are described in EP193478, US2004/081815, and WO2009/068541.

Specific Embodiments

The ballistic material comprises a stack of sheets containing reinforcing linear tension members. In the following, a number of specific embodiments of the present invention will be discussed, In one embodiment, the stack is a compressed stack, in which the individual sheets are adhered to each other to provide a ballistic panel, for example, for use in ballistic vests.

In another embodiment the stack comprises substacks of, for example, 2-10 sheets. Said substacks may be compressed substacks and/or flexible substacks. A flexible substack may be obtained, for example, by stitching the edges of the sheets together. A compressed substack may be a consolidated package of a number of sheets, for example, from 2 to 8 sheets, e.g., as a rule 2, 4 or 8 sheets. Consolidated is intended to mean that the sheets are firmly attached to one another. The sheets may be consolidated by the application of heat and/or pressure, as is known in the art.

In another embodiment, the stack comprises substacks of, for example 2-10 sheets, which substacks are combined at the edges to form a flexible ballistic stack.

In one embodiment, the stack comprises at least two substacks, wherein a first substack is a consolidated stack and a second substack is a flexible substack present below (from the strike-side of the panel) the first substack. In this embodiment the first substack is preferably a polyethylene-rich layer, and the second substack preferably is an aramid-rich layer.

In one embodiment the stack comprises a compressed substack of sheets comprising polyethylene and/or aramid linear tension members and a flexible substack comprising polyethylene and/or aramid linear tension members. The flexible substack may be, for example, stitched onto the compressed substack or adhered onto the compressed substack or the substacks may be held together on the edges or by placing them in a bag or a cover.

With respect to the total amount of linear tension members in the stack, in one embodiment, the stack comprises 1-20 wt. % of aramid linear tension members, in particular 1-10 wt. %, and, preferably, 80-99 wt. % of polyethylene linear tension members, in particular 90-99 wt. % (all percentages calculated on the total weight of linear tension members).

In another embodiment, the stack comprises 15-40 wt. % of aramid linear tension members, in particular 15-30 wt. %, and, preferably, 85-60 wt. % of polyethylene linear tension members, in particular 85-70 wt. % (all percentages calculated on the total weight of linear tension members).

In one embodiment, the ballistic resistant article is a stack, in particular a molded stack, which comprises from top (i.e. strike face) to bottom a first layer and a second layer, wherein the first layer comprises sheets based on polyethylene linear tension members, in particular polyethylene tapes. In this embodiment, the linear tension members in the first layer consist of at least 70 wt. % of polyethylene, in particular at least 80 wt. %, still more in particular at least 90 wt. %, yet more in particular at least 95 wt. %. In one embodiment, the linear tension members in the first layer consist essentially of polyethylene. Where polyethylene tapes are used, the first layer may contain 0-12 wt. % of a matrix material. While some matrix material may be required to cause the tapes to adhere together, the provision of more than 12 wt. % of matrix material may not be required, and may be detrimental to the ballistic properties of the panel.

The first layer of the stack may make up between 20 and 99 wt. % of the stack. In one embodiment, the first layer makes up between 30 and 90 wt. % of the stack, in particular between 30 and 80 wt. %, more in particular between 30 and 70 wt. % of the stack, more in particular between 40 and 60 wt. %. In another embodiment, the first layer makes up between 50 and 99 wt. % of the stack, in particular between 60 and 99 wt. %, more in particular between 70 and 99 wt. %. In a further embodiment, the first layer may make up between 80 and 99 wt. %, more in particular between 90 and 99 wt. %, or even between 95 and 99 wt. %.

The second layer of the ballistic material of this embodiment comprises sheets, which contain aramid linear tension members, in particular aramid fibers. In this embodiment, the linear tension members in the second layer consist of at least 70 wt. % aramid material, in particular at least 80 wt. %, or at least 90 wt. %. In one embodiment, the linear tension members in the second layer consist essentially of aramid material. The aramid linear tension members may be fibers.

In the aramid-rich layer a matrix material may also be present. In the case of fibers, this may, for example, be in the range of 5-30 wt. %, more in particular in the range of 15 wt. %.

The ballistic panel of this embodiment may, for example, meet the requirements of class II of the NU Standard-0101.04 P-BPS performance test. In an embodiment, the requirements of class Ilia of said Standard are met, in an embodiment, the requirements of class III are met, or the requirements of even higher classes.

This ballistic performance may be accompanied by a low areal weight, in particular an areal weight of at most 19 kg/m2, more in particular at most 16 kg/m2. In some embodiments, the areal weight of the stack may be as low as 15 kg/m2. The minimum areal weight of the stack is given by the minimum ballistic resistance required.

In an embodiment, the stack is a compressed stack of sheets or of consolidated sheet packages, wherein the first layer consists essentially of polyethylene linear tension members and the second layer consists essentially of aramid linear tension members. The stack may comprise at least 80 wt. % polyethylene, for example, at least 90 wt. % polyethylene or at least 95 wt. % polyethylene.

In another embodiment, the first polyethylene-rich layer is a compressed substack and the second aramid-rich layer is a flexible substack. The stack may comprise at least 80 wt. % of polyethylene, more in particular at least 90 wt. % of polyethylene, even more in particular at least 95 wt. % of polyethylene. The compressed substack of this embodiment may comprise sheets consisting essentially of polyethylene linear tension members and optionally may further comprise sheets consisting essentially of aramid linear tension members. For example, the compressed substack may consist essentially of polyethylene or may generally comprise at least 1 wt. % aramid, in particular at least 5 wt. % aramid, more in particular at least 10 wt. % aramid, or even more in particular 20 wt. % aramid.

The flexible substack of this embodiment may comprise sheets consisting essentially of aramid linear tension members and optionally may further comprise sheets consisting essentially of polyethylene linear tension members. The flexible substack may consist essentially of aramid linear tension members.

In another embodiment, the ballistic resistant article is a stack, in particular a molded stack, which comprises, from top to bottom, a first layer and a second layer, wherein each layer is a compressed substack. In a particular embodiment, both layers are polyethylene-rich layers and the composition of each polyethylene-rich layer may be the same or different. In a yet more particular embodiment, the compressed substack at or closer to the strike face comprises sheets consisting essentially of polyethylene linear tension members and sheets consisting essentially of aramid linear tension members compressed together, whereas the second layer comprises sheets consisting essentially of polyethylene linear tension members.

In a further embodiment, the ballistic resistant article is a stack comprising from top to bottom, a compressed layer and a flexible layer, wherein the compressed layer comprises from top to bottom a first polyethylene-rich layer and a second aramid-rich layer, and wherein the flexible layer is an aramid-rich layer. The total stack may comprise 60-99 wt. % polyethylene, for example, 75-90 wt. % polyethylene, and 40-1 wt. % aramid, for example, 25-10 wt. % aramid. The aramid-rich layer may make up 1-15, for example, 1-10 wt. % of the compressed stack.

In another embodiment, a curved ballistic item, for example a helmet, comprises, from top to bottom, an aramid-rich layer, for example an all-aramid layer, a polyethylene-rich layer, for example an all-polyethylene layer, and a further aramid-rich layer.

For all embodiments: The polyethylene linear tension members may be tapes as discussed above. The aramid linear tension members may be fibers as discussed above.

The Matrix Material

A matrix material may be present in the ballistic material. When the ballistic-resistant article is a molded article, a matrix material may be used to cause the individual sheets to adhere to each other.

The term "matrix material" means a material which binds the linear tension members and/or the sheets together. Where the linear tension members are fibers, the matrix material may be required to adhere the fibers together to form unidirectional sheets. The use of sheets comprising woven linear tension members may decrease the need for using matrix material, as the members are bonded together through their woven structure. Therefore, this may allow the use of less matrix material or even no matrix material.

In one embodiment, the ballistic-resistant molded article does not contain a matrix material. While it is believed that the matrix material may have a lower contribution to the ballistic effectivity of the system than the tapes, the matrix-free embodiment may make an efficient material based on its ballistic effectivity per weight ratio.

In another embodiment, the ballistic resistant article comprises a matrix material. In this embodiment, the matrix material may improve the delamination properties of the material and may contribute to the ballistic performance.

In one embodiment, the matrix material is provided within the sheets themselves, which may help adhere the linear tension members to each other, for example, to provide a sheet of unidirectional fibers, or to stabilize a fabric after weaving.

In another embodiment, the matrix material is provided on the sheet to adhere the sheet to further sheets within the stack.

One way of providing the matrix material onto the sheets may be the use of one or more films of the matrix material on the top side, bottom side, or both sides of the sheets. The films may be adhered to the sheet, e.g., by passing the films together with the sheet through a heated pressure roll or press.

Another way of providing the matrix material onto the sheets may be by applying an amount of a liquid substance containing the organic matrix material onto the sheet. This embodiment may allow for simple application of the matrix material. The liquid substance may be, for example, a solution, a dispersion, or a melt of the organic matrix material. If a solution or a dispersion of the matrix material is used, the process may also comprise evaporating the solvent or dispersant. Furthermore, the matrix material may be applied in vacuo. The liquid material may be applied homogeneously over the entire surface of the sheet. However, it is also possible to apply the matrix material in the form of a liquid material inhomogeneously over the surface of the sheet. For example, the liquid material may be applied in the form of dots or stripes, or in any other suitable pattern.

In one embodiment, the matrix material is applied in the form of a web, wherein a web is a discontinuous polymer film, that is, a polymer film with holes. This may allow for the provision of low weights of matrix materials.

In another embodiment, the matrix material is applied in the form of strips, yarns, or fibers of polymer material, the latter may be, for example, in the form of a woven or non-woven yarn or fiber web or other polymeric fibrous weft. Again, this may allow for the provision of low weights of matrix materials.

In various embodiments described above, the matrix material is distributed inhomogeneously over the sheets. In one embodiment, the matrix material is distributed inhomogeneously within the compressed stack. In this embodiment, more matrix material may be provided where the compressed stack encounters the most influences from outside, which may detrimentally affect stack properties.

The matrix material may wholly or partially consist of a polymer material, which optionally may contain fillers usually employed for polymers. The polymer may be a thermoset or thermoplastic or mixtures of bothA soft plastic may be used, for example, the organic matrix material may be an elastomer with a tensile modulus (at 25° C.) of at most 41 MPa. Non-polymeric organic matrix material may also be used. The matrix material may help adhere the tapes and/or the sheets together, where required, and any matrix material which attains this purpose may be suitable as matrix material. The elongation to break of the organic matrix material may be greater than the elongation to break of the reinforcing tapes. The elongation to break of the matrix may be from 3 to 500%. These values apply to the matrix material as it is in the final ballistic-resistant article.

Thermosets and thermoplastics that are suitable for the sheet may be listed, for example, in EP 833742 and WO-A-91/12136.

Vinylesters, unsaturated polyesters, epoxides, or phenol resins may be chosen as matrix material from the group of thermosetting polymers. These thermosets usually are in the sheet in partially set condition (the so-called B stage) before the stack of sheets is cured during compression of the ballistic-resistant molded article. From the group of thermoplastic polymers, polyurethanes, polyvinyls, polyacrylates, polyolefins or thermoplastic, elastomeric block copolymers such as polyiso-prene-polyethylenebutylene-polystyrene or polystyrene-polyisoprenepolystyrene block copolymers may be chosen as matrix material.

When a matrix material is used, it may be applied in an amount of at least 0.2 wt. %, for example, at least 1 wt. %, at least 2 wt. %, or at least 2.5 wt. %. Matrix material may generally be applied in an amount of at most 30 wt. %. The use of more than 30 wt. % of matrix material may not improve the properties of the molded article.

The amount of matrix material may also depend on whether the linear tension members are tapes or fibers. In the case of fibers, a matrix material may be used to provide a sheet containing parallel fibers adhered together. In this case, a matrix content of the sheet of 10-30 wt. % may be mentioned, in particular 15-25 wt. %.

Where the linear tension members are tapes, a lower amount of matrix material may be used. In some embodiments, it may be preferred for the matrix material to be present in an amount of at most 12 wt. %, preferably at most 8 wt. %, more preferably at most 7 wt. %, sometimes at most 6.5 wt. %.

Aramid, Chemical Composition

As used herein, the word "aramid" refers to linear macromolecules made up of aromatic groups, wherein at least 60% of the aromatic groups are joined by amide, imide, imidazole, oxalzole, or thiazole linkages and at least 85% of the amide, imide, imidazole, oxazole, or thiazole linkages are joined directly to two aromatic rings with the number of imide, imidazole, oxazole, or thiazole linkages not exceeding the number of amide linkages. In an embodiment, at least 80% of the aromatic groups are joined by amide linkages, for example at least 90% or at least 95%.

In one embodiment, of the amide linkages, at least 40% are present at the para-position of the aromatic ring, preferably at least 60%, more preferably at least 80%, still more preferably at least 90%. The aramid may be a para-aramid, that is, an aramid wherein essentially all amide linkages are adhered to the para-position of the aromatic ring.

In one embodiment of the present invention the aramid is an aromatic polyamide consisting essentially of 100 mole % of:

A. at least 5 mole % but less than 35 mole %, based on the entire units of the polyamide, of units of formula (1)

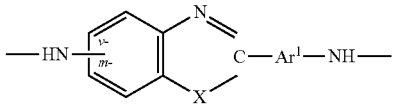

wherein $Ar^1$ is a divalent aromatic ring whose chain-extending bonds are coaxial or parallel and is a phenylene, biphenylene, naphthylene or pyridylene, each of which may have a substituent which is a lower alkyl, lower alkoxy, halogen, nitro, or cyano group, X is a member selected from the group consisting of 0, S, and NH, and the NH group bonded to the benzene ring of the above benzoxazle, benzothiazole, or benzimidazole ring is meta or para to the carbon atom to which X is bonded of said benzene ring;

B. 0 to 45 mole %, based on the entire units of the polyamide, of units of formula (2)

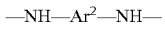

wherein $Ar^2$ is the same in definition as $Ar^1$, and is identical to or different from $Ar^1$, or is a compound of formula (3)

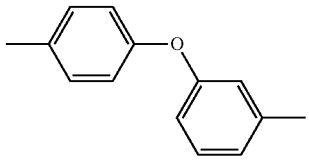

C. an equimolar amount, based on the total moles of the units of formulae (1) and (2) above, of a structural unit of formula (4)

wherein $Ar^3$ is

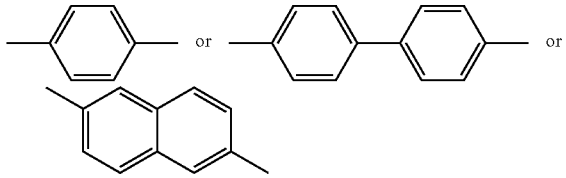

in which the ring structure optionally contains a substituent selected from the group consisting of halogen, lower alkyl, lower alkoxy, nitro, and cyano; and D. 0 to 90 mole %, based on the entire units of the polyamide, of a structural unit of formula (5) below —NH—$Ar^4$—CO— wherein $Ar^4$ is the same in definition as $Ar^1$, and is identical to or different from $Ar^1$.

The aramid may be polyp-phenylene terephthalamide), which is known as PPTA. PPTA is the homopolymer resulting from mole-for-mole polymerization of p-phenylenediamine and terephthaloyl chloride. The aramid may also be copolymers resulting from incorporation of other diamines or diacid chlorides replacing p-phenylenediamine and terephthaloyl chloride respectively.

Polyethylene, Chemical Composition, and Manufacture

The polyethylene, whether indicated as polyethylene, high-molecular weight polyethylene, or ultra-high molecular weight polyethylene, may have a weight average molecular weight of at least 300,000 g/mol. Linear polyethylene, as used herein, means polyethylene having fewer than 1 side chain per 100 C atoms, for example fewer than 1 side chain per 300 C atoms. The polyethylene may also contain up to 5 mol % of one or more other alkenes, which may be copolymerisable therewith, such as propylene, butene, pentene, 4-methylpentene, and octene. The polyethylene may have a weight average molecular weight of at least 500,000 g/mol. The use of tapes, in particular fibres or tapes, with a molecular weight of at least $1*10^6$ g/mol may be preferred. The maximum molecular weight of the polyethylene suitable for use in the present invention is not critical. As a general value, a maximum value of $1*10^8$ g/mol may be mentioned. The molecular weight distribution may be determined as is described in WO2009/109632.

In one embodiment, polyethylene linear tension members are used with a relatively narrow molecular weight distribution. This may be expressed by the Mw (weight average molecular weight) over Mn (number average molecular weight) ratio of at most 6, for example at most 5, at most 4, at most 3, at most 2.5, or at most 2.

In an embodiment, the polyethylene tapes with a high molecular weight and the stipulated narrow molecular weight distribution may have a high molecular orientation, as may be evidenced by their XRD diffraction pattern.

In one embodiment, the polyethylene linear tension members are tapes having a 200/110 uniplanar orientation parameter Φ of at least 3. The 200/110 uniplanar orientation parameter Φ is defined as the ratio between the 200 and the 110 peak areas in the X-ray diffraction (XRD) pattern of the tape sample, as determined in reflection geometry. Wide angle X-ray scattering (WAXS) is a technique that provides information on the crystalline structure of matter. The technique specifically refers to the analysis of Bragg peaks scattered at wide angles. Bragg peaks result from long-range structural order. A WAXS measurement produces a diffraction pattern, i.e. intensity as function of the diffraction angle 2Θ (this is the angle between the diffracted beam and the primary beam). The 200/110 uniplanar orientation parameter gives information about the extent of orientation of the 200 and 110 crystal planes with respect to the tape surface. For a tape sample with a high 200/110 uniplanar orientation, the 200 crystal planes may be highly oriented parallel to the tape surface. A high uniplanar orientation may be accompanied by a high tensile strength and high tensile energy to break. The ratio between the 200 and 110 peak areas for a specimen with randomly oriented crystallites is around 0.4. However, in the tapes used in one embodiment, the crystallites with indices 200 may be oriented parallel to the film surface, which may result in a higher value of the 200/110 peak area ratio and, therefore, in a higher value of the uniplanar orientation parameter. The UHMWPE tapes with narrow molecular weight distribution used in one embodiment of the ballistic material may have a 200/110 uniplanar orientation parameter of at least 3, for example at least 4, at least 5, at least 7, at least 10, or at least 15. The theoretical maximum value for this parameter is infinite if the peak area 110 equals zero. High values for the 200/110 uniplanar orientation parameter may often be accompanied by high values for the strength and the energy to break. For a determination method of this parameter, reference is made to WO2009/109632.

In one embodiment, the UHMWPE tapes, in particular UHMWPE tapes with an Mw/MN ratio of at most 6 have a DSC crystallinity of at least 74%, more in particular at least 80%. The DSC crystallinity may be determined using differential scanning calorimetry (DSC), for example on a Perkin Elmer DSC7. Thus, a sample of known weight (2 mg) is heated from 30 to 180° C. at 10° C. per minute, held at 180° C. for 5 minutes, then cooled at 10° C. per minute. The results of the DSC scan may be plotted as a graph of heat flow (mW or mJ/s; y-axis) against temperature (x-axis). The crystallinity is measured using the data from the heating portion of the scan. An enthalpy of fusion ΔH (in J/g) for the crystalline melt transition is calculated by determining the area under the graph from the temperature determined just below the start of the main melt transition (endotherm) to the temperature just above the point where fusion is observed to be completed. The calculated ΔH is then compared to the theoretical enthalpy of fusion ($\Delta H_\alpha$ of 293 J/g) determined for 100% crystalline PE at a melt temperature of approximately 140° C. A DSC crystallinity index is expressed as the percentage 100 ($\Delta H/\Delta H_\alpha$) In one embodiment, the tapes used in the present invention have a DSC crystallinity of at least 85%, more in particular at least 90%.

In general, the polyethylene linear tension members, may have a polymer solvent content of less than 0.05 wt. %, for example less than 0.025 wt. %, or less than 0.01 wt. %. In one embodiment, the polyethylene tapes may have a high strength in combination with a high linear density. As used herein, the linear density is expressed in dtex, which is the weight in grams of 10,000 meters of film. In one embodiment, the film has a linear density of at least 3000 dtex, for example at least 5000 dtex, at least 10000 dtex, at least 15000 dtex, or at least 20000 dtex, in combination with strengths of, as specified above, at least 2.0 GPa, for example at least 2.5 GPA, at least 3.0 GPa, at least 3.5 GPa, or at least 4.

Suitable tapes may encompass those described in WO2009/109632, the relevant parts of which are incorporated herein by reference.

In one embodiment, the manufacture of ballistic articles occurs by a process comprising the steps of providing sheets comprising linear tension members, stacking the sheets in such a manner that the direction of the linear tension members within the stack is not unidirectionally, and adhering at least some of the sheets to each other, wherein some of the linear tension members are linear tension members comprising ultra-high molecular weight polyethylene and some of the linear tension members comprise aramid. The adhering of the sheets may be done in manners known in the art. In the manufacture of soft-ballistics this may be done, for example, by stitching the edges of the sheets together to form sheet packages. In one embodiment, molded ballistic panels are manufactured by a process comprising the steps of providing sheets comprising linear tension members, stacking the sheets in such a manner that the direction of the linear tension members within the stack is not unidirectionally, and compressing the stack under a pressure of at least 0.5 MPa. The pressure to be applied may ensure the formation of a ballistic-resistant may article with adequate properties. The pressure may be at least 0.5 MPa. A maximum pressure of at most 50 MPa may be mentioned. Where necessary, the temperature during compression may be selected such that the matrix material is brought above its softening or melting point, if this is necessary to cause the matrix to help adhere the linear tension members and/or sheets to each other.

Compression at an elevated temperature, as used herein, is intended to mean that the molded article is subjected to the given pressure for a particular compression time at a compression temperature above the softening or melting point of the organic matrix material and below the softening or melting point of the linear tension members. The required compression time and compression temperature may depend on the nature of the linear tension members and matrix material and on the thickness of the molded article. Where the compression is carried out at elevated temperature, it may be preferred for the cooling of the compressed material to also take place under pressure. Cooling under pressure, as used herein, is intended to mean that the given minimum pressure is maintained during cooling at least until so low a temperature is reached that the structure of the moulded article can no longer relax under atmospheric pressure. Where applicable, cooling at the given minimum pressure may correspond to a temperature at which the organic matrix material has largely or completely hardened or crystallized and below the relaxation temperature of the linear tension members. The pressure during the cooling does not need to be equal to the pressure at the high temperature. During cooling, the pressure may be monitored so that appropriate pressure values may be maintained, to compensate for decrease in pressure caused by shrinking of the molded article and the press.

Depending on the nature of the matrix material, for the manufacture of a ballistic-resistant molded article in which the linear tension members in the sheet comprise high-drawn tapes of high-molecular weight linear polyethylene, the compression temperature may be 115 to 135° C. and cooling to below 70° C. may be effected at a constant pressure. As used herein, the temperature of the material, e.g., compression temperature, refers to the temperature at half the thickness of the molded article.

In one embodiment, the stack is built up from consolidated sheet packages containing from 2 to 8, as a rule 2, 4 or 8. For the orientation of the sheets within the sheet packages, reference is made to what has been stated above for the orientation of the sheets within the stack.

As used herein, consolidated is intended to mean that the sheets are firmly attached to one another. Very good results may be achieved if the sheet packages, too, are compressed. The sheets may be consolidated by the application of heat and/or pressure, as is known in the art.

EXAMPLES

Several ballistic materials were manufactured as follows.

Compressed stacks or substacks were manufactured by cross-plying sheets of the appropriate materials and amounts to form a stack. The stack was compressed at a temperature of 132° C., at a pressure of 60 bar. The material was cooled down and removed from the press to form a compressed stack or substack.

Flexible substacks were manufactured by stitching the edges of individual sheets together.

If the substacks were not molded simultaneously to form a single stack, the substacks were held together before shooting.

The panels had a total areal weight of 15.5 kg/m2.

PE sheets were manufactured by aligning tapes in parallel to form a first layer, aligning at least one further layer of tapes onto the first layer parallel and offset to the tapes in the first layer, and heat-pressing the tape layers to form a sheet. UHMW polyethylene tapes with a width of 80 mm and a thickness of 55 μm were used. The tapes had a tensile strength of 2.3 GPa, a tensile modulus of 165 GPa. A single type of PE sheets was used. The sheets of type A are 0-90° X-plies of approximately 220 μm thickness (matrix content: 3 wt. %)

Two types of aramid sheets were used. Laminated aramid sheets were manufactured by unidirectionally aligning PPTA aramid fibers in a styrene-isoprene-styrene matrix with an outer coating of low-molecular weight PE (matrix content about 20 wt. %). This system will be indicated as aramid UD. Sheets based on aramid fabric were made by an aramid fabric, commercially known as Twaron CT 736 fabric from Teijin, with polyphenolic resin as matrix (matrix content 11 wt. %). This system will be indicated as aramid textile.

Different panels were manufactured with varying amounts of PE and aramid according to Table 1, by appropriately stacking the corresponding PE-based sheets and/or aramid-based sheets.

The PE: aramid ratios correspond to wt. % of polyethylene sheets (including matrix) with respect to wt. % of aramid sheets (including matrix) based on the total weight of the system.

TABLE 1

Composition of the panels

| Panel | Composition |
|---|---|
| Comp. 1 | 100% PE, compressed |
| Comp. 2 | 100% PE, compressed |
| Comp. 3 | 100% PE, compressed |
| Ex. 1 | 80% PE layer, 20% aramid UD layer, compressed in single stack |
| Ex. 2 | $1^{st}$ substack: compressed stack of 80% PE and 3% aramid textile sheet<br>$2^{nd}$ substack: flexible stack of 17% aramid UD |
| Ex. 3 | 97% PE layer, 3% aramid textile layer, compressed in single stack |
| Ex. 4 | $1^{st}$ substack: compressed stack of 80% PE and 3% aramid textile<br>$2^{nd}$ substack: compressed stack of 17% PE |

The panels were tested for trauma evaluation in accordance with NIJ III 01.04.04. The velocity used ranged from 838 to 856 m/s. It was found that the bullets were stopped in the panel. The results of the comparative panels, which all have the same composition, are averaged.

TABLE 2

| Performance of the panels | | | |
|---|---|---|---|
| Panel | Bullet stop[1] | Trauma[2] [mm] | Relative trauma[3] |
| Comp. | SIP | 44[4] | — |
| Ex. 1 | SIP | 44 | 1% |
| Ex. 2 | SIP | 42 | −5% |
| Ex. 3 | SIP | 44 | 1% |
| Ex. 4 | SIP | 42 | −4% |

[1]SIP: Bullet stopped in panel

[2]Average value from 3 different shoots

[3]Relative trauma refers to the percentage of increase or decrease of trauma, with positive and negative percentages respectively, of the hybrid panels (PE plus aramid) with respect to the panels comprising PE only with the same type of PE.

[4]Average reference value from 9 different shoots on three different panels

The results of Table 2 show that the performance of the hybrid panels, i.e. comprising both polyethylene and aramid (Examples 1-5) is equivalent to that of panels consisting of polyethylene or is even improved with respect to the reduction of trauma (Examples 2 and 4). It is noted that the generally accepted maximum amount of trauma is 44 mm.

FIGS. 1 through 3 are pictures of the front and the back of the panels of Comparative Example 1 and Examples 1 and 3, taken after 5 shots.

As can be seen from the pictures, the back of the ballistic panels is notably improved in the materials comprising aramid (Examples 1 and 3), whereby the bullet fragments stay within the antiballistic panel and the back of the panel is improved with respect to that of all polyethylene (Comparative Example 1).

The invention claimed is:

1. A ballistic-resistant article comprising a stack of sheets containing reinforcing linear tension members, a direction of the linear tension members within the stack being not unidirectionally, wherein some of the linear tension members are linear tension members comprising high molecular weight polyethylene and some of the linear tension members comprise aramid, and wherein the stack comprises from a strike face down a first layer that contains more than 50 wt % of the polyethylene linear tension members and a second layer that comprises more than 50 wt % of the aramid linear tension members, the wt % being based on the total weight of the linear tension members in the layer, excluding any matrix material.

2. The ballistic-resistant article according to claim 1, wherein the linear tension members comprising high molecular weight polyethylene are polyethylene tapes with a width of at least 5 nm.

3. The ballistic-resistant article according to claim 1, wherein the linear tension members comprising aramid are poly(p-phenylene terephthalamide).

4. The ballistic-resistant article according to claim 1, wherein the stack comprises sheets which contain both polyethylene linear tension members and aramid linear tension members.

5. The ballistic-resistant article according to claim 1, wherein the stack comprises sheets which contain polyethylene linear tension members and are free of aramid-type linear tension members, and/or sheets which contain aramid-type linear tension members and are free of polyethylene linear tension members.

6. The ballistic-resistant article according to claim 1, wherein the linear tension members in the sheets are unidirectionally oriented, and a direction of linear tension members in a sheet is rotated with respect to a direction of linear tension members in an adjacent sheet.

7. The ballistic-resistant article according to claim 1, wherein a sheet comprises woven linear tension members.

8. The ballistic-resistant article according to claim 7, wherein the sheet comprises one of polyethylene and aramid linear tension members as warp or weft and the other of polyethylene and aramid tension members as weft or warp.

9. A consolidated sheet package suitable for use in the manufacture of a ballistic-resistant article of claim 1, wherein the consolidated sheet package comprises sheets containing linear tension members, a direction of the linear tension members within the consolidated sheet package is not unidirectional, some of the linear tension members are linear tension members containing ultra-high molecular weight polyethylene, some of the linear tension members contain aramid, and wherein the stack comprises from the strike face down a first layer which contains more than 50 wt % of the polyethylene linear tension members and a second layer which comprises more than 50 wt % of the aramid linear tension members, the wt % being based on the total weight of the linear tension members in the layer, excluding any matrix material.

10. A method for manufacturing a ballistic-resistant article according to claim 1, comprising the steps of:

providing sheets containing linear tension members, stacking the sheets in such a manner that a direction of the linear tension members within a stack is not unidirectinoally, and adhering at least some of the sheets to each other, wherein some of the linear tension members are linear tension members containing ultra-high molecular weight polyethylene, some of the linear tension members contain aramid, and wherein the stack comprises from the strike face down a first layer which contains more than 50 wt % of the polyethylene linear tension members and a second layer which comprises more than 50 wt % of the aramid linear tension members, the wt % being based on the total weight of the linear tension members in the layer, excluding any matrix material.

11. The method according to claim 10, further comprising compressing the stack under a pressure of at least 0.5 MPa.

* * * * *

UNITED STATES PATENT AND TRADEMARK OFFICE

CERTIFICATE OF CORRECTION

PATENT NO. : 8,993,087 B2
APPLICATION NO. : 13/518562
DATED : March 31, 2015
INVENTOR(S) : Soon Joo Bovenschen et al.

It is certified that error appears in the above-identified patent and that said Letters Patent is hereby corrected as shown below:

On the Title Page:

Item (30) change:

"Dec. 23, 2009 (EP) ..... 09180611" to --Dec. 23, 2009 (EP) ..... 09180611.7--;

In the Specification:

Column 7,
Line 50, change "yam" to --yarn--;
Line 56, change "yams" to --yarns--;

Column 9,
Line 21, change "NU" to --NIJ--;
Line 22, change "P-BPS" to --P-BFS--;

Column 11,
Line 27, change "bothA" to --both. Preferably a--;
Line 29, change "(at 25° C)" to --(at 25°C)--;

Column 13,
Line 21, change "polyp-phenylene" to --poly(p-phenylene--;

Column 14,
Line 59, change "GPA" to --GPa--.

Signed and Sealed this
Fifteenth Day of September, 2015

Michelle K. Lee

Michelle K. Lee
*Director of the United States Patent and Trademark Office*